US006289818B1

(12) United States Patent
Mueller et al.

(10) Patent No.: US 6,289,818 B1
(45) Date of Patent: Sep. 18, 2001

(54) STAGE SEPARATION SYSTEM AND METHOD

(75) Inventors: George E. Mueller, Kirkland; David B. Cochran, Bellevue, both of WA (US)

(73) Assignee: Kistler Aerospace Corporation, Kirkland, WA (US)

( * ) Notice: Subject to any disclaimer, the term of this patent is extended or adjusted under 35 U.S.C. 154(b) by 0 days.

(21) Appl. No.: 09/263,470

(22) Filed: Mar. 5, 1999

(51) Int. Cl.[7] ..... F42B 15/10

(52) U.S. Cl. ..... 102/377; 102/378

(58) Field of Search ..... 102/377, 378

(56) References Cited

U.S. PATENT DOCUMENTS 5,218,165 * 6/1993 Cornelius et al. ..... 102/378
5,227,579 * 7/1993 Gibson et al. ..... 102/378
5,318,255 * 6/1994 Facciano et al. ..... 102/378 X
5,671,650 * 9/1997 Aubret ..... 102/378 X

* cited by examiner

*Primary Examiner*—Peter A. Nelson
(74) *Attorney, Agent, or Firm*—Christensen O'Connor Johnson Kindness PLLC

(57) ABSTRACT

An aerospace vehicle for delivering a payload into space includes a first stage and a second stage with a plurality of separation assemblies coupling the first stage to the second stage. At least one container charged with pressurized gas in fluid communication with the separation assemblies provides pressurized gas to the separation assemblies to cause separation of the first stage and the second stage.

18 Claims, 4 Drawing Sheets

FIG. 4
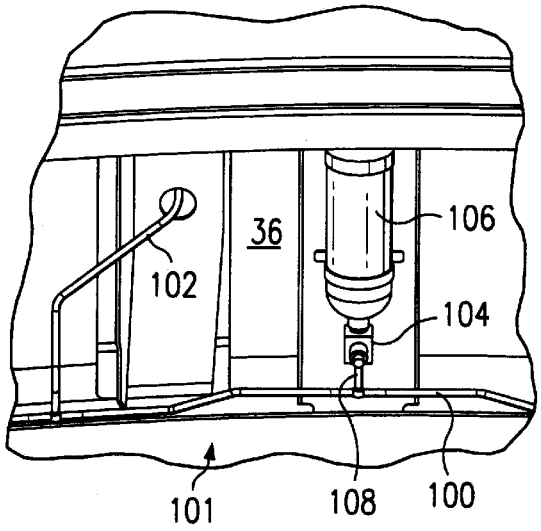
FIG. 7
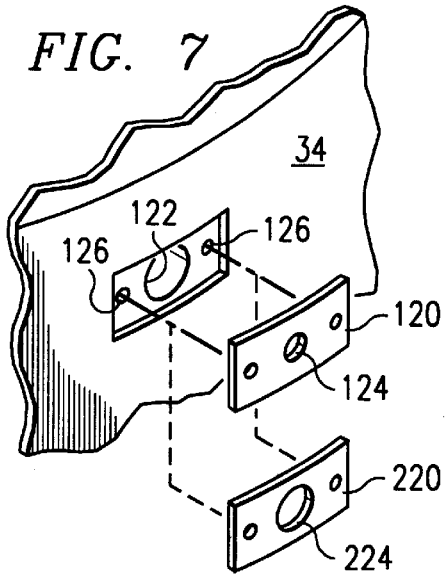
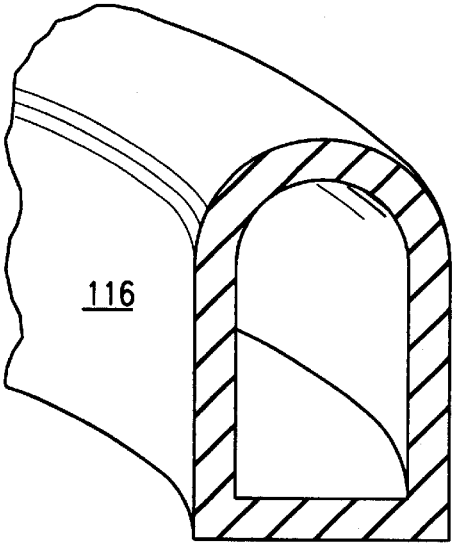
FIG. 6
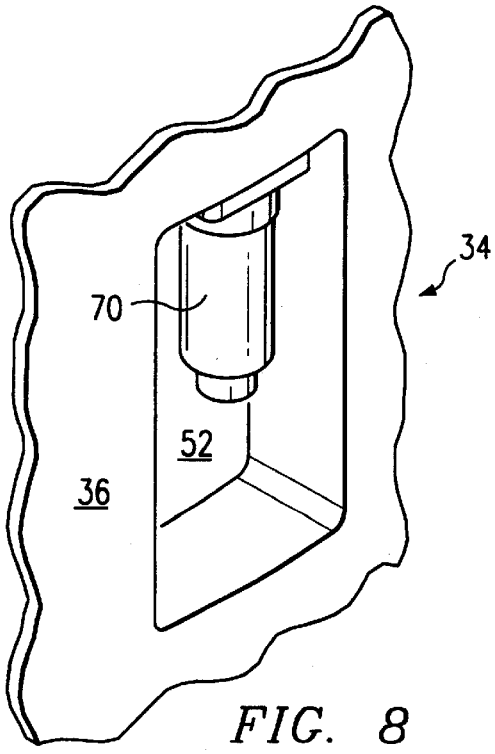
FIG. 8

STAGE SEPARATION SYSTEM AND METHOD

TECHNICAL FIELD OF THE INVENTION

The present invention relates to aerospace vehicles and, in particular, to a stage separation system and method.

BACKGROUND OF THE INVENTION

Multistage aerospace vehicles are widely used to carry payloads into orbit and propel space vehicles into outer space. One or more booster stages accelerate an orbital stage, or vehicle, toward space. Depleted booster stages are generally dropped in order to reduce the weight of the aerospace vehicle. After each booster stage has served its purpose in attaining a certain velocity, it separates from the next stage and falls back to earth.

Timely and proper separation of stages in an aerospace vehicle often requires intricate planning and design, and typically involves high-cost, sensitive hardware and instrumentation. Separation is often accomplished by detonating pyrotechnic devices in a predetermined sequence which in turn disengage the mechanical connection between stages.

Pyrotechnic devices, however, are hazardous explosives, and inherently expensive to manufacture, deliver and handle. Therefore, the number of pyrotechnic devices employed in a given system has significant cost implications. Furthermore, the shock and debris of pyrotechnic devices may have a deleterious effect on other system components including the booster stage(s) and orbital vehicle because they cause structural damage above and beyond that required for separation. This collateral damage increases with the number of devices utilized and impacts the ability to reuse system components for subsequent launches.

SUMMARY OF THE INVENTION

An object of the present invention is to reduce the cost of placing aerospace vehicles or payloads in earth orbits and space, and in particular, to provide a multistage separation system which employs a limited number of pyrotechnic devices. Another object is to enhance the efficiency of separation of multistage aerospace vehicles. Yet another object is to minimize damage to aerospace vehicles caused by pyrotechnic devices. Still another object is to provide a safe, reliable, cost-effective separation system for multistage aerospace vehicles.

The foregoing objects are attained in accordance with the present invention by employing a separation system which requires a limited number of pyrotechnic devices. In a particular embodiment, a first stage and a second stage are provided with a plurality of separation assemblies coupling the first stage to the second stage. At least one container charged with pressurized gas in fluid communication with the separation assemblies may also be provided. The container provides pressurized gas to the separation assemblies to cause separation of the first stage and the second stage.

In another embodiment of the present invention, a first stage and a second stage may be coupled to define a cavity between the first stage and the second stage. An orifice operable to provide fluid communication between the cavity and external ambient may also be provided.

In yet another embodiment, a separation system for use on a multistage aerospace vehicle includes a manifold and a plurality of containers filled with pressurized gas, in fluid communication with the manifold. A plurality of separation nut assemblies in fluid communication with the manifold are also provided. A plurality of valves are disposed between the manifold and the containers. The valves, upon actuation, release the pressurized gas for delivery to the separation nut assemblies.

A technical advantage of the present invention includes the limited number of pyrotechnic devices required to effectuate the safe and efficient separation of the stages. By limiting the number of pyrotechnic devices, collateral damage to the structural components of the aerospace vehicle is minimized, as well as the amount of flying debris generated. This allows the operator to refurbish and reuse the aerospace vehicle during subsequent launches.

Another technical advantage includes separation of the stages using trapped air to prevent unwanted side velocities, uneven separation, and structural damage. The trapped air may be controllably released to establish predetermined separation forces.

Other technical advantages are readily apparent to one skilled in the art from the following figures, description, and claims.

BRIEF DESCRIPTION OF THE DRAWINGS

For a more complete understanding of the present invention, and for further features and advantages, reference is now made to the following description, taken in conjunction with the accompanying drawings, in which:

FIG. 4 is a partial perspective view from a point on the interior of the launch assist platform;

FIG. 6 is a cross-sectional view of a "D" seal, in an undeformed state;

FIG. 7 is an exploded perspective view, with portions broken away, illustrating pressure control orifices; and FIG. 8 is a partial perspective view, with portions broken away, looking from a point to the side and above the launch assist platform, illustrating a separation nut assembly accessible from the outside of the vehicle.

DETAILED DESCRIPTION OF THE INVENTION

Figure 1:
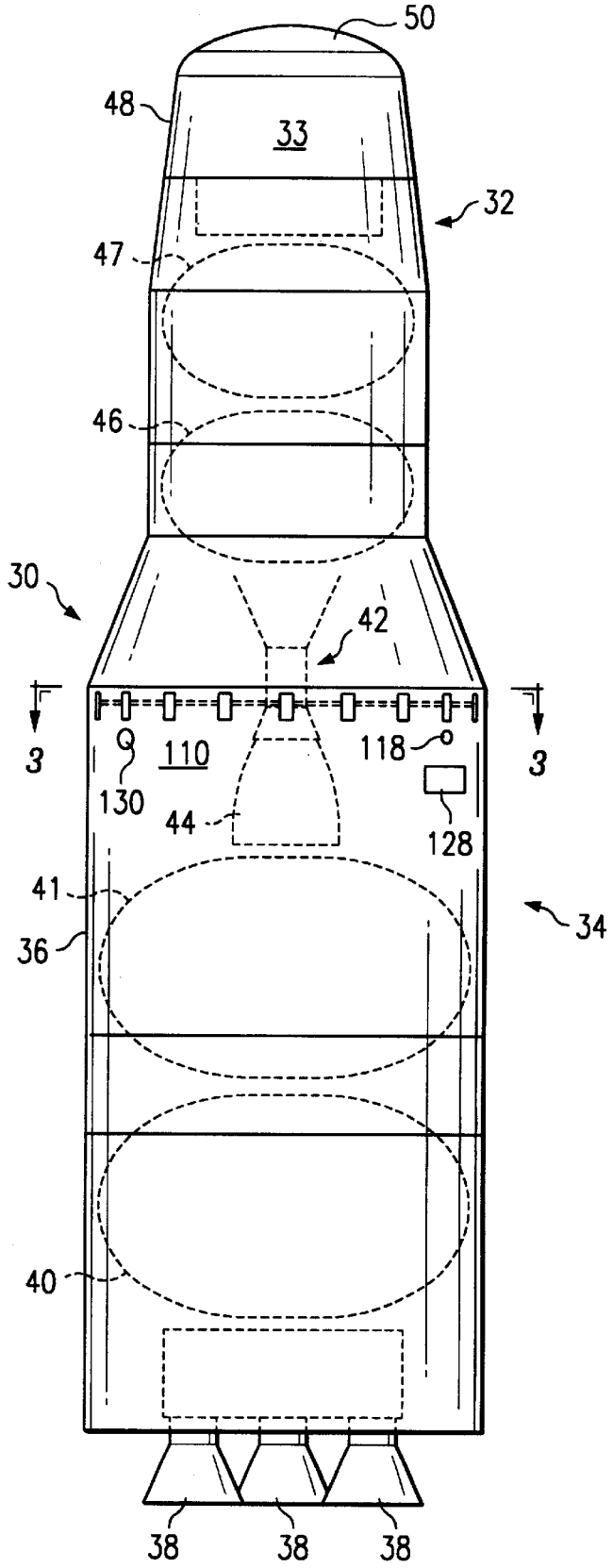
FIG. 1 is a side elevation view of a launch vehicle that includes an orbital vehicle and launch assist platform embodying the present invention.

Referring to FIG. 1, a launch vehicle 30 is illustrated which includes an orbital vehicle 32 and a booster stage, or launch assist platform 34, which propels orbital vehicle 32 toward an orbit around the earth. The juncture of orbital vehicle 32 and launch assist platform 34 is indicated by cross-section 3—3 and further illustrated in FIG. 3. The two-stage combination of orbital vehicle 32 and launch assist platform 34 delivers a payload 33 into earth orbit. Launch assist platform 34 may be used alone or in combination with one or more additional booster stages to assist a space vehicle in reaching earth orbit or outer space. While the illustrated embodiment encompasses a two-stage launch vehicle, the teachings of the present invention apply to separation techniques and structures between stages of an aerospace vehicle.

In the present embodiment, launch assist platform 34 includes a body that is essentially a tubular, aerodynamic outer shell 36 of cylindrical shape which is constructed in major part by internal ribbed tubular panels of a composite material. Launch assist platform 34 derives its power from one or more liquid oxygen/kerosene main propulsion engines 38. A liquid oxygen (LOX) propellant tank 41 and kerosene fuel tank 40 are encased within launch assist platform 34, and thermally isolated from the ribbed tubular panels of outer shell 36. Liquid oxygen stored within propellant tank 41 and kerosene stored within fuel tank 40 is supplied to main propulsion engines 38 to provide thrust to launch assist platform 34 during take-off and flight of launch vehicle 30.

The propulsion system 42 associated with orbital vehicle 32 includes engine 44, liquid oxygen propellant tank 47 and kerosene fuel tank 46. After separation of launch assist platform 34 from orbital vehicle 32, liquid oxygen stored within propellant tank 47 and kerosene stored within fuel tank 46 are supplied to engines 44 to provide thrust to orbital vehicle 32. The orbital vehicle includes a blunt nose 50, which is generally parabolic shaped, and outer shell 48 formed from ribbed tubular panels of a composite material.

Orbital vehicle 32 and launch assist platform 34 define a cavity 110 at their juncture. An orifice 118 provides fluid communication between cavity 110 and external ambient. Air and/or pressurized gas trapped within cavity 110 may be selectively released through orifice 118. Pressure relief valves 128 may be used in lieu of, or in addition to orifice 118, to maintain a specified pressure differential between cavity 110 and external ambient. This trapped air pressure release system will be described later, in more detail.

In one embodiment, launch vehicle 30 may be used to deliver communications satellites into low earth orbit. The components of launch vehicle 30 may be fully reusable in excess of one hundred launch applications. Launch vehicle 30 of FIG. 1 is approximately one hundred fifteen feet in overall length, twenty-two feet in diameter and may weigh in excess of eight hundred and five thousand pounds at lift off. During operation, main engines 38 provide the thrust necessary to achieve lift off and sustain flight of launch vehicle 30 to a predetermined elevation and trajectory. A separation system to be described in more detail later decouples orbital vehicle 32 from launch assist platform 34. Main engines 38 provide the necessary thrust to maneuver launch assist platform 34 to a predetermined location where a chute and airbag system is deployed, which allows launch assist platform 34 to safely return to the earth's surface for recovery and reuse.

Shortly after separation, engine 44 ignites to propel orbital vehicle 32 into earth orbit. Payload 33 is then deployed to remain in an orbital trajectory. A de-orbit burn provided by an orbital maneuvering engine then allows orbital vehicle 32 to exit earth's orbit and return to earth. At a predetermined elevation, another chute and airbag system deploys to allow orbital vehicle 32 to land safely on the earth's surface. Orbital vehicle 32 and launch assist platform 34 are then collected to be retrofitted and refueled for another launch sequence to deploy an additional payload.

Figure 2:
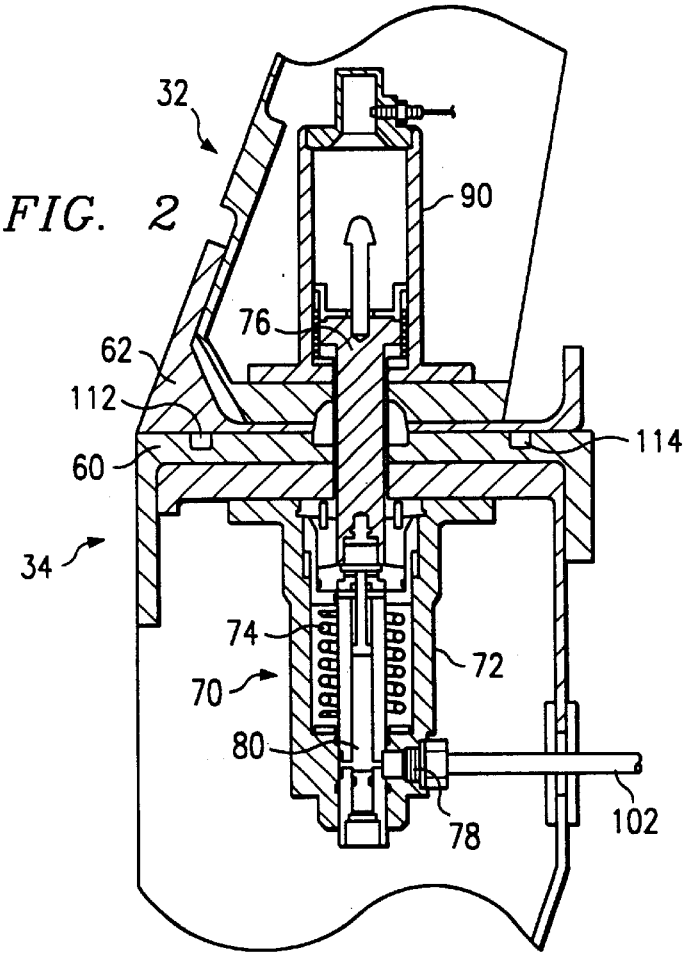
FIG. 2 is a partial cross-section, with portions broken away, illustrating a portion of the juncture between the orbital vehicle and launch assist platform.

FIG. 2 illustrates a portion of the juncture between launch assist platform 34 and orbital vehicle 32. A flanged portion 60 of launch assist platform 34 couples to a flanged portion 62 of orbital vehicle 32 using separation nut assembly 70. Separation nut assembly 70 includes an outer housing 72 surrounding a retainer spring 74. A cartridge port 78 connects to branch piping section 102. Pressure chamber 80 provides a fluid communication path between branch piping section 102 and separation bolt 76.

A bolt retainer 90 is optionally provided and mounted to orbital vehicle 32 to capture and retain separation bolts 76 upon actuation of separation nut assembly 70 and separation of launch assist platform 34 from orbital vehicle 32. Actuation of separation nut assembly 70 releases bolt 76 which is retained within bolt retainer 90. This helps minimize the amount of flying debris generated during the separation stage of the launch which could otherwise damage structural components of launch vehicle 30 and create hazards for other aircraft, as well as structures and populations below. Separation nut assemblies 70 are actuated by introducing pressurized gas through branch piping section 102 to cartridge port 78 of separation nut assembly 70.

Figure 3:
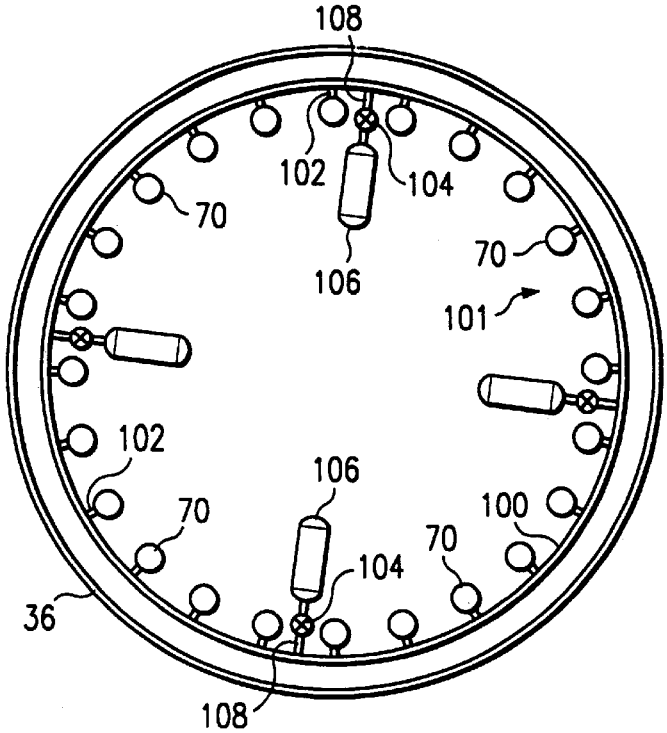
FIG. 3 is a generally schematic view of the juncture between the orbital vehicle and launch assist platform taken along lines 3—3 of FIG. 1.

FIG. 3 is a cross section and illustrates portions of separation system 101. Manifold 100 is installed along the perimeter of outer shell 36 of launch assist platform 34 near the interface between launch assist platform 34 and orbital vehicle 32. Manifold 100 includes a circular tube with a hollow generally tubular cross-section. A plurality of branch piping sections 102 provide fluid communication paths between manifold 100 and separation nut assemblies 70. Pressurized containers 106 secure to the interior of outer shell 36 of launch assist platform 34. In one embodiment, pressurized tank 106 is charged with nitrogen gas ($N_2$), but it should be recognized that other gases, including helium gas ($H_2$), can be utilized. Branch piping sections 108 provide fluid communication paths between pressurized containers 106 and manifold 100.

Pyrotechnic valves 104 are disposed within branch piping sections 108 and maintained in a typically "closed" position until actuation of the separation nut assemblies 70 is desired. A PCR 1/2-20 Power Cartridge as produced by Hi-Shear Technology Corporation, for example, is suitable for use within the teachings of the present invention. Upon actuation of pyrotechnic valves 104, fluid communication is established between pressurized containers 106 and manifold 100, allowing trapped gas to travel through pyrotechnic valves 104 which are in the "open" position, through branch piping sections 108 fully charging manifold 100 almost instantaneously. Pressurized gas then proceeds through branch piping sections 102 into separation nut assembly 70 via cartridge port 78. In another embodiment, mechanical and/or electromechanical valves may be used interchangeably with, or instead of pyrotechnic valves 104.

In one embodiment, pressurized containers 106 may be charged with Helium gas to a pressure of 7,500 psi. Nitrogen gas may also be introduced into manifold 100 prior to launch, to affect a faster overall charge. As an example, manifold 100 may be pre-charged with nitrogen gas to a pressure of 2,500 psi. When helium gas within pressurized container 106 and nitrogen gas within manifold 100 are used in combination, the chemical reaction caused by the mixing of the gases enhances the performance of the system facilitating more rapid actuation of separation nut assemblies 70. It will be recognized by those of ordinary skill in the art that many types of compressed gas are available for use interchangeably within manifold 100 and pressurized containers 106.

FIG. 4 illustrates a partial perspective view of a portion of separation system 101. Although the fluid communication path described includes manifold 100, and branch piping sections 102 and 108, it should be recognized by those of ordinary skill in the art that any reference to a manifold may include any piping, fittings, and branch lines necessary to allow fluid communication between pressurized containers 106 and separation nut assemblies 70.

Figure 5:
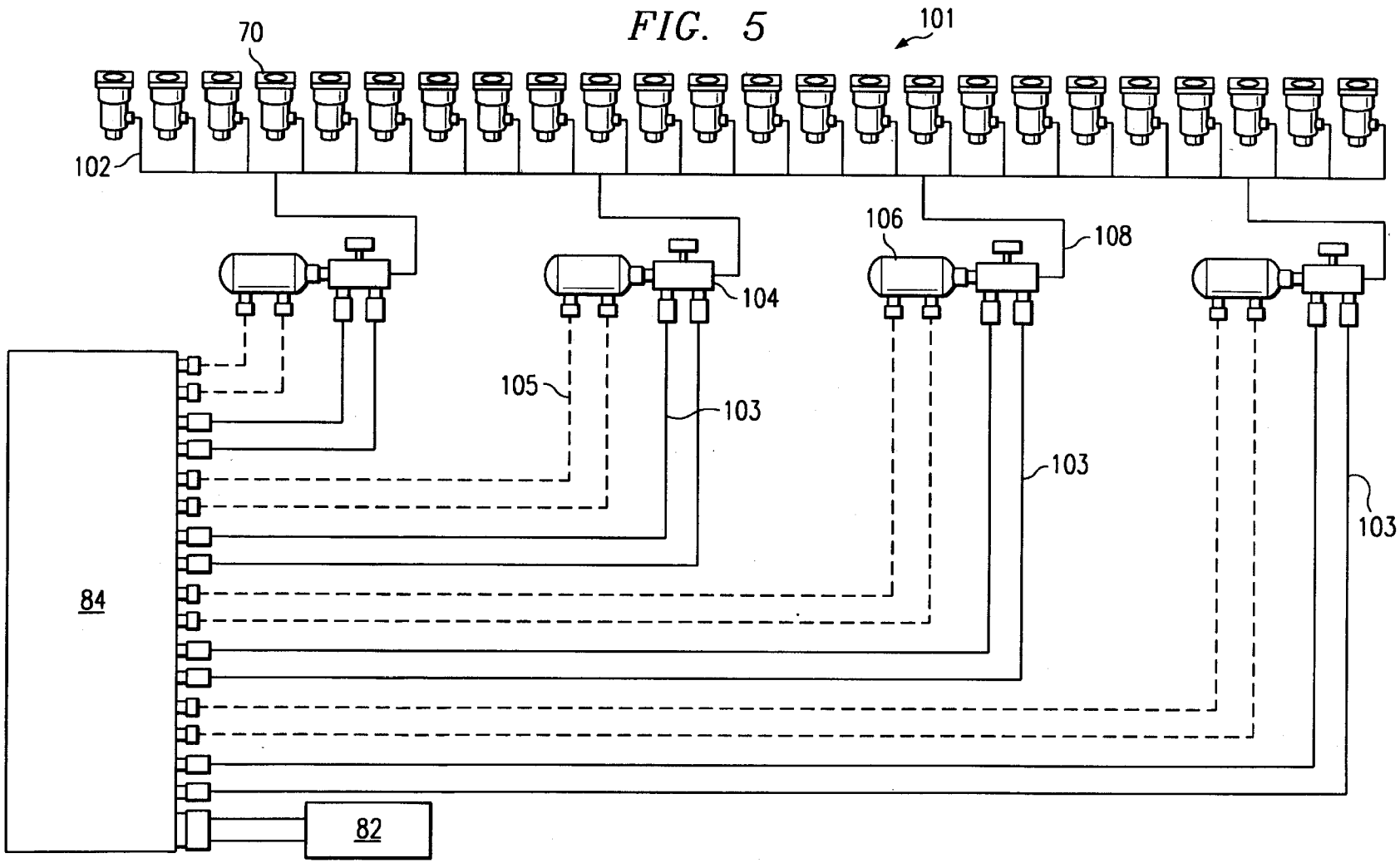
FIG. 5 is an electrical/pneumatic interconnect block diagram.

FIG. 5 illustrates a piping and instrumentation diagram of separation system 101. A battery pack 82 provides power to a controller or central processing unit (CPU) 84 which controls the actuation of pyrotechnic valves 104. Upon command, CPU 84 actuates pyrotechnic valves 104 using signal lines 103, allowing gas contained within pressurized containers 106 to enter branch piping sections 102, charging manifold 100. Separation nut assemblies release when a predetermined amount of pressure is transferred from manifold 100 through branch piping sections 102 to separation nut assemblies 70. CPU also includes redundant sensor lines 105 to monitor the pressure of compressed gas in pressurized containers 106. Any number of specific configurations of the components of separation system 101 are available in lieu of the system illustrated in FIG. 5. As an example, valves may be provided within manifold 100 essentially partitioning the system such that each pressurized container 106 services a specific number of separation nut assemblies. In one embodiment, four pressurized containers may be employed to service a total of twenty-four separation nut assemblies which would allow a design wherein each pressurized container services a total of six separation nut assemblies. In another embodiment, the ratio of separation assemblies to containers charged with pressurized gas may exceed 6:1. In order to avoid errors or complications caused by faulty components, redundancy may also be introduced into the separation system components. For example, each pressurized container may service six primary separation nut assemblies 70 and also provide "backup" to an additional six in case of equipment failure.

In one particular embodiment, low shock separation nuts within the SN9400 Series as manufactured by Hi-Shear Technology Corporation of Torrance, Calif. are suitable for as separation assemblies in separation system 101. Such bolts facilitate a torque of 140 foot-pounds applied to the mechanical connection between orbital vehicle 32 and launch assist platform 34. In another embodiment, separation assemblies 70 may be programmed to release when pressure in the range of four to five thousand pounds per square inch is introduced at the cartridge port. In a particular embodiment, release of all separation assemblies 70 associated with separation system 101 may then be accomplished in less than eight milliseconds. Many releasable mechanical couplings, or separation assemblies, are available for use as separation assemblies, within the teachings of the present invention.

Once the structural bond of separation assemblies 70 is broken, the physical separation of orbital vehicle 32 from launch assist platform 34 of launch vehicle 30 of FIG. 1 is enhanced by a volume of trapped air occupying interior cavity 110 defined by components of launch assist platform 34 and orbital vehicle 32. This volume of air may be maintained at a predetermined pressure. Throughout the flight of launch vehicle 30, the pressure within interior cavity 110 remains higher than ambient atmospheric pressure since ambient atmospheric pressure will decrease steadily corresponding to any increase in elevation. The pressure within interior cavity 110 may be controlled passively through orifice 118 or pressure relief valves 128 or actively using sensors.

Launch vehicle 30 includes interior cavity 110 (FIG. 1) which occupies the space between and within portions of orbital vehicle 32 and launch assist platform 34. Interior cavity 110 is defined at its perimeter by outer shells 36 and 48 of launch assist platform 34 and orbital vehicle 32, respectively. The lower boundary of interior cavity 110 is defined by propellant tank 41 of launch assist platform 34 and the upper extreme is defined by fuel tank 46 of orbital vehicle 32. Launch assist platform 34 is assembled in a manner in which air cannot pass between propellant tank 41 and outer shell 36. Similarly, orbital vehicle 32 is assembled such that air is prevented from traveling between fuel tank 46 and outer shell 48. Although many components of launch vehicle 30 occupy interior cavity 110, including propulsion system 42 of orbital vehicle 32 and other components, a significant volume remains wherein air and other gases may be contained.

When launch vehicle 30 is assembled prior to launch, the juncture between launch assist platform 34 and orbital vehicle 32 forms a generally airtight seal. A circular notched opening 112 (FIG. 2) with a generally rectangular cross section is provided near the outermost perimeter of flanged portion 60 of launch assist platform 34. A similar circular notched opening 114 (FIG. 2) is provided near the innermost perimeter of flanged portion 60 of launch assist platform 34. A pair of circular "D" seals 116, the cross-section of which is illustrated in FIG. 6, are inserted into circular notched openings 112 and 114 during the assembly of launch vehicle 30. When separation bolt 76 is torqued down, flanged portion 62 of orbital vehicle 32 compresses "D" seals 116 within circular notched openings 112 and 114, thereby creating a generally airtight seal between flanged portion 62 of orbital vehicle 32 and flanged portion 60 of launch assist platform 34. Although the illustrated embodiment utilizes two "D" seals 116 to close any opening which may exist between flanged portion 60 and flanged portion 62, a single "D" seal may be sufficient. Alternatively, it will be recognized by those skilled in the art that many other methods of establishing this generally airtight seal are available. For example, flanged portions 60 and 62 may be machined in such a manner that "D" seal 116 would not be required to establish a substantially airtight seal.

In one embodiment, circular notched openings 112 and 114 may have cross-sectional dimensions of 0.312" wide by 0.3" tall. Within the same embodiment, "D" seals 116 may have a cross-sectional overall width of 0.31" and overall height of 0.5". Separation system 101 may incorporate any number, shape, size and configuration of circular notched openings 112 and 114, as well as "D" seals 116, to provide a substantially airtight seal. "D" seal 116 of the illustrated embodiment is suitable to fill manufacturing, assembly, and frame gapping of approximately 0.121".

After the assembly of launch vehicle 30 prior to launch, interior cavity 110 is substantially airtight with respect to ambient atmospheric pressure. Accordingly, the pressure within interior cavity 110 will remain at whatever ambient pressure is prevalent at the elevation where assembly is accomplished. This pressure may fall within the range of 10–15 psi according to the assembly and launch sites currently being contemplated. Once interior cavity 110 is sealed, this pressure may be maintained regardless of changes encountered in ambient atmospheric pressure due to changes in elevation experienced during the launch and flight of launch vehicle 30.

In order to selectively control the dissipation of pressure within cavity 110, an orifice 118 may be provided within outer shell 36 of launch assist platform 34. Orifice 118 provides a fluid communication path between interior cavity 110 and the ambient atmosphere. Orifice 118 may be located anywhere along the perimeter of interior cavity 110 along either outer shell 36 of launch assist platform 34 or outer shell 48 of orbital vehicle 32 or both. Any number of the same or differently sized additional orifices may also be employed, although the illustrated embodiment contemplates the use of a single orifice 118. The appropriate size of orifice 118 will depend upon a number of factors including, but not limited to, its location upon launch vehicle 30, the elevation of the assembly and launch, the elevation at which the separation will be accomplished, the time from launch to separation, the amount of pressure necessary to accomplish the physical separation of orbital vehicle 32 from launch assist platform 34, the effectiveness of the generally airtight seal for cavity 110, and other fluid dynamic characteristics associated with the launch and flight of launch vehicle 30. The use of orifice 118 is not required to affect the separation of orbital vehicle 32 from launch assist platform 34, but provides a mechanism by which pressure within interior cavity 110 may be passively controlled to a predetermined level at separation.

FIG. 7 illustrates a plate 120 of a composite or metallic material. Since launch vehicle 30 is intended to be fully reusable and the fluid dynamics associated with each flight may vary significantly, the illustrated embodiment facilitates rapid modification and interchangeability of the size of orifice 118. Plate 120 is suitable for installation upon launch assist platform 34. In order to allow pressure dissipation from within interior cavity 110, a fixed orifice 122 is provided within launch assist platform 34. Composite plate 120 is then installed over fixed orifice 122 such that composite plate 120 completely covers fixed orifice 122. A variable orifice 124 is provided within composite plate 120 and aligned with fixed orifice 122 to control the dissipation of pressure from within interior cavity 110. Fixed orifice 122 may be provided at any size suitable to be completely covered by composite plate 120. Variable orifice 124 controls pressure dissipation from interior cavity 110 and its size is therefore controlling in the design of the required pressure dissipation system.

Variable orifice 124 is provided within composite plate 120 to accommodate the rapid interchangeability of various variable orifice sizes. When a different size variable orifice is required due to specific design considerations, composite plate 120 may be removed from launch assist platform 34 quickly and efficiently by removing mechanical fasteners 126. Another composite plate 220 with a different size variable orifice 224 may then be installed upon launch assist platform 34.

For another launch with different launch conditions, fixed orifice 122 and therefore, composite plate 120 containing variable orifice 124, may be installed anywhere within the perimeter of interior cavity 110 provided fluid communication with an area of lower pressure is provided. The position of any orifice may be adjusted due to the dynamics of hypersonic flows and vortexing. In the illustrated embodiment, composite plate 120 is provided along the upper perimeter of outer shell 48 of launch assist platform 34 by way of example only.

Another method for selectively controlling pressure dissipation from within interior cavity 110 uses one or more pressure relief valves 128 (FIG. 1) installed upon the outer perimeter of interior cavity 110. Pressure relief valves 128 form a fluid communication path between interior cavity 110 and the ambient atmosphere. Pressure relief valves 128 are preset to allow pressure within interior cavity 110 to escape to the atmosphere until a desired pressure differential across pressure relief valve 128 is accomplished. In this manner, the pressure differential between interior cavity 110 and ambient atmosphere can be maintained at a predetermined level to ensure the optimum performance of the trapped air pressure separation system.

As an example, pressure relief valves 128 may be preset to maintain a pressure differential of approximately 3 to 8 psi, ensuring that the pressure within interior cavity 110 will remain 3 to 8 psi higher than ambient atmospheric pressure at all times during flight. In this manner, the volume of trapped air within interior cavity 110 between orbital vehicle 32 and launch assist platform 34 is allowed to retain pressure 6.5 psi greater than ambient and this pressure is used to force the stages apart upon separation. In another embodiment of the present invention, cavity 110 may be pre-charged with air or gas to maintain a higher pressure than ambient launch pressure. The shape and configuration of engines 44 further enhance the separation of stages from a "plunger" type effect which forces gasses out around the nozzle of engine 44, upon separation. In one embodiment, a distance of 150' to 200' may be achieved between orbital vehicle 32 and launch assist platform 34 prior to ignition of engine 44.

Although the illustrated embodiment includes one pressure relief valve, the number, size, specifications and location of the pressure relief valves may be significantly modified to achieve various design goals for a particular launch and flight. For some applications, no pressure relief valves are required. Furthermore, many other methods are available for controlling the pressure differential between ambient atmospheric pressure and the pressure within interior cavity 110. For a more active control, a pressure transducer 130 (see FIG. 1) may be installed within interior cavity 110 in order to determine the pressure within cavity 110. A control valve may also be provided in lieu of pressure relief valve 128 to maintain or decrease the pressure within interior cavity 110, in response to signals from pressure transducer 130.

As illustrated in FIG. 8, launch vehicle 30 may be modified to allow for convenient and rapid adjustment of separation assemblies 70 by allowing access from the exterior of launch vehicle 30. As illustrated in FIG. 8, outer shell 36 of launch assist platform 34 may be provided with a rectangularly shaped recess 52 around each separation assembly 70. Final adjustment and torque of separation assemblies 70 may then be accomplished after assembly of launch vehicle 30. Furthermore, separation assemblies may be provided which allow for access through the separation assembly to the threaded end of separation bolt 76 for preloading. Accordingly, the time required for assembly and/or disassembly is drastically reduced. Recess 52 may also be utilized to provide access to install, remove and/or replace pyrotechnic valves 104 without disassembling orbital vehicle 32.

Although the present invention has been described in several embodiments, a myriad of changes, variations, alterations, transformations, and modifications may be suggested to one skilled in the art, and it is intended that the present invention encompass such changes, variations, alterations, transformations, and modifications as fall within the spirit and scope of the appended claims.

What is claimed is:

1. An aerospace vehicle for delivering a payload into space, comprising:

a first stage;

a second stage;

a plurality of separation assemblies coupling the first stage and the second stage;

a container charged with pressurized gas in fluid communication with the separation assemblies, the container operable to actuate the separation assemblies to cause separation of the first stage and the second stage; and a plurality of bolt retainers adapted to capture loose hardware generated by actuation of the separation assemblies.

2. The vehicle of claim 1, wherein the container provides pressurized gas to at least six separation assemblies.

3. The vehicle of claim 1, further comprising a manifold coupled to the container and at least one separation assembly.

4. The vehicle of claim 1, further comprising:

a transducer operable to determine the pressure within a cavity between the first stage and the second stage; and a control valve operable to selectively regulate the pressure within the cavity in response to the determined pressure to produce a separation force.

5. An aerospace vehicle for delivering a payload into space, comprising:

a first stage; and a second stage coaxially coupled to the first stage with a plurality of separation assemblies to define a substantially sealed cavity between the first stage and the second stage;

whereby pressure-generated forces in the cavity caused by a decrease in the external ambient pressure will bias the first stage away from the second stage.

6. The vehicle of claim 5, further comprising a seal disposed between the first stage and the second stage to form a substantially airtight seal between the first stage and the second stage.

7. The vehicle of claim 5, further comprising an orifice providing a restricted fluid path between the cavity and external ambient pressure and a removable plate overlaying the orifice and having a second orifice sized to regulate pressure in the cavity.

8. The vehicle of claim 5, further comprising at least one pressure relief valve operable to limit the pressure differential between the cavity and the external ambient pressure.

9. A separation system for use on an aerospace vehicle, comprising:

a manifold;

a plurality of containers filled with pressurized gas, the containers in fluid communication with the manifold;

a plurality of separation assemblies in fluid communication with the manifold; and a plurality of valves disposed between the manifold and the containers, wherein actuation of the valves releases the pressurized gas for delivery to the separation assemblies.

10. The separation system of claim 9, wherein the valves are pyrotechnic valves.

11. The separation system of claim 9, wherein the ratio of separation assemblies to containers is at least 6:1.

12. A separation system for an aerospace vehicle of the type with a first stage and a second stage coaxially attached to the first stage with a plurality of pneumatically operable separation nuts that will disengage at an activation pressure, the separation system comprising:

a manifold fluidly connecting the plurality of separation nuts;

a source of gas pressurized at least to the separation nut activation pressure;

an electronically operable valve fluidly connecting the source of pressurized gas to the manifold; and a control system connected to the electronically operable valve;

wherein the control system controllably opens the valves to pressurize the manifold, thereby disengaging the separation nuts and releasing the first stage from the second stage.

13. The separation system of claim 12 wherein the control system further comprises a battery operated central processing unit.

14. The separation system of claim 12 wherein the manifold is pre-pressurized to a pressure less than the separation nut activation pressure with a gas that is reactive with the gas from the source of pressurized gas.

15. The separation system of claim 14 wherein the manifold pre-pressurization gas is nitrogen gas and the source of pressurized gas provides helium gas.

16. The separation system of claim 12 further comprising a plurality of bolt retainers adapted to capture loose hardware generated by disengagement of the separation bolts.

17. The separation system of claim 16 comprising at least six separation nuts fluidly connected to the manifold.

18. The separation system of claim 12 further comprising at least one additional source of pressurized gas, and at least one additional electronically operable valve fluidly connecting each additional source of pressurized gas to the manifold.

* * * * *

UNITED STATES PATENT AND TRADEMARK OFFICE

CERTIFICATE OF CORRECTION

PATENT NO. : 6,289,818 B1
DATED : September 18, 2001
INVENTOR(S) : G.E. Mueller et al.

It is certified that error appears in the above-identified patent and that said Letters Patent is hereby corrected as shown below:

Title page,

Item [56], References Cited, U.S. PATENT DOCUMENTS, insert in appropriate order the following:

| | | | |
|---|---|---|---|
| -- | 5,060,888 | 10/1991 | Vezain et al. |
| | 5,129,602 | 7/1992 | Leonard |
| | 5,158,248 | 10/1992 | Mockovciak, Jr. |
| | 5,141,181 | 8/1992 | Leonard |
| | 5,238,209 | 8/1993 | Hornyak |
| | 5,395,149 | 3/1995 | Herman et al. |
| | 5,400,713 | 3/1995 | Humiston et al. |
| | 5,531,067 | 7/1996 | Koppel |
| | 5,568,901 | 10/1996 | Stiennon |
| | 5,585,596 | 12/1996 | Richards et al. |
| | 5,667,167 | 9/1997 | Kistler |
| | 5,743,492 | 4/1998 | Chan et al. |
| | 4,796,839 | 1/1989 | Davis -- |

Insert in appropriate order the following:

| | | | |
|---|---|---|---|
| -- | 3,221,656 | 12/1965 | Sutten |
| | 3,384,016 | 5/1968 | Blanchard, Jr. |
| | 3,437,285 | 4/1969 | Manfredi et al. |
| | 3,501,112 | 3/1970 | Webb |
| | 3,534,686 | 10/1970 | Watson |
| | 3,606,212 | 9/1971 | Paine |
| | 3,738,597 | 6/1973 | Earl et al. |
| | 4,171,663 | 10/1979 | Day et al. |
| | 4,625,619 | 12/1986 | Ceniza |
| | 4,646,994 | 3/1987 | Petersen et al. |
| | 4,649,824 | 3/1987 | Guay |
| | 4,834,324 | 5/1989 | Criswell |
| | 4,884,770 | 12/1989 | Martin -- |

UNITED STATES PATENT AND TRADEMARK OFFICE

CERTIFICATE OF CORRECTION

PATENT NO. : 6,289,818 B1
DATED : September 18, 2001
INVENTOR(S) : G.E. Mueller et al.

It is certified that error appears in the above-identified patent and that said Letters Patent is hereby corrected as shown below:

References Cited cont'd,
OTHER PUBLICATIONS, insert in appropriate order the following:
-- OTHER PUBLICATIONS
IAF 92-0859 Antares: A Low Cost Modular Launch Vehicle Concept, by Bruckner, et al., Department of Aeronautics and Astronautics, Univ. of Washington, Seattle, WA 98195, 43rd Congress of the Intl. Astronautical Federation, 08/28-09/05/92, 1992.

International Reference Guide to Space Launch Systems, by Isakowitz, 1991, AIAA, 1991. --

Signed and Sealed this

First Day of October, 2002

*Attest:*

*Attesting Officer*

JAMES E. ROGAN
*Director of the United States Patent and Trademark Office*